US005990396A

United States Patent [19]

Lasner

[11] Patent Number: 5,990,396

[45] **Date of Patent: *Nov. 23, 1999**

[54] NECK FOR STRINGED MUSICAL INSTRUMENTS

[75] Inventor: Richard M. Lasner, Mill Valley, Calif.

[73] Assignee: Modulus Guitars, L.L.C., Novato, Calif.

[ * ] Notice:

This patent issued on a continued prosecution application filed under 37 CFR 1.53(d), and is subject to the twenty year patent term provisions of 35 U.S.C. 154(a)(2).

[21] Appl. No.: 08/625,176

[22] Filed: Mar. 29, 1996

[51] Int. Cl.[6] ..... G10D 3/00

[52] U.S. Cl. ..... 84/293; 84/291; 84/267

[58] Field of Search ..... 84/293, 291, 267

[56] References Cited

U.S. PATENT DOCUMENTS

| | | | |
|---|---|---|---|
| 3,251,257 | 5/1966 | Bunker | 84/267 |
| 4,121,492 | 10/1978 | Berardi | 84/293 |
| 4,304,277 | 12/1981 | Petillo | 84/293 |
| 4,846,038 | 7/1989 | Turner | 84/293 |
| 4,846,039 | 7/1989 | Mosher | 84/293 |
| 5,018,423 | 5/1991 | Bunker | 84/293 |
| 5,180,876 | 1/1993 | Thorward | 84/293 |
| 5,353,672 | 10/1994 | Stewart | 84/293 |
| 5,465,642 | 11/1995 | Goto | 84/293 |

FOREIGN PATENT DOCUMENTS 2230890A 10/1990 United Kingdom .

OTHER PUBLICATIONS

Bacon, Tony, "The Ultimate Guitar Book ," Knoff, 1991, Ill. 2A–B.

"The Electric Guitar—an illustrated history ," p. 156, Chronical Books, 1993.

"The Luthier's Mercantile Catalog–Handbook for Stringed Instrument Builders ," pp. 99, 101.

Cherne Steven, "3rd Edition Blue Book of Guitars," pp. 433–434, 460.

Tanaka, Yuji, "History of Electric Guitars", two pages, 1984.

Gruhn, George & Carter, Walter., "Acoustic Guitars and Other Fretted Instruments", pp. 50,197.

Wheeler, Tom, "American Guitars an Illustrated History", pp. 57,81, 1982.

Moonstone Guitars Eclipse Bass promotional material, 1981.

Pacifica Model 1221 promotional material.

*Primary Examiner*—Robert E. Nappi
*Assistant Examiner*—Kim Lockett
*Attorney, Agent, or Firm*—Baker & Botts, L.L.P.

[57] ABSTRACT

A stringed musical instrument having a neck assembly, a body portion, and a plurality of strings, the neck assembly having a composite central structure made of a composite material which is sufficiently strong to withstand the entire load imposed on the neck assembly by the tension of the strings without deformation or the need for structural reinforcement. The neck assembly also includes at least one non-structural, non-load bearing wooden insert carried by the composite central structure and extending substantially along the length of the neck assembly, for enabling the stringed instrument to have the response and tonal coloration of stringed instruments with traditional wooden neck assemblies, a fingerboard carried by the composite central structure, and a non-structural, non-load bearing truss rod assembly for relief adjustment of the neck.

2 Claims, 5 Drawing Sheets

NECK FOR STRINGED MUSICAL INSTRUMENTS

This invention relates to the neck structure of a stringed musical instrument, and more particularly to an adjustable neck structure which provides the strength and durability of composite necks, and the response and tonal coloration of wooden necks.

BACKGROUND OF THE INVENTION

Traditionally, necks of stringed instruments have been made of wood. Wooden necks, however, tend to bend and warp under the load imposed on them by the tension of the strings, due to exposure to temperature or humidity variations, or due to aggressive playing styles. In attempts to alleviate these inherent problems, prior art wooden neck constructions have incorporated truss rods, or other additional structural elements, within the neck to bear some of the load exerted on the neck by the strings. Prior art neck constructions have also incorporated separate adjustment mechanisms to correct any warping or bending which has already occurred.

One such prior art neck construction is shown in U.S. Pat. No. 5,018,423. This patent discloses a neck construction which includes a metal rod within a wooden neck which extends from the base of the peg head to the body of the stringed instrument. This rod functions as a truss rod for adjusting the vertical space between the strings and the neck, or, in other words, for adjusting the position of the fingerboard and the neck structure relative to the plane of the strings (otherwise known as relief adjustment) to suit user preferences. The rod also functions as a structural element which bears most of the load exerted on the neck by the strings. The neck structure also includes an additional device for rotatably adjusting the neck to compensate for any bending or warping which may occur.

Neck compositions of this type do reduce stress induced deformation of the wooden neck, but are limited in their effectiveness. Any neck in which wood is a structural element will inevitably undergo a certain amount of deformation, be it due to string tension, humidity, temperature, or aggressive use. Devices such as that shown in U.S. Pat. No. 5,018,423 can only counteract and/or correct such deformations. Furthermore, since the rod serves as the relief adjustment mechanism as well as the primary load bearing element, its ability to make and maintain fine adjustments is severely limited.

Another prior art device which has used a structural reinforcement in a wooden neck is U.S. Pat. No. 4,304,277. This device provides two opposing reinforcing members separated by a spacer. Grip members are attached to each of the reinforcing members for the purpose of giving the instrument the physical look and feel of an instrument with a wooden neck. The reinforcing members, the spacer, and the grip members all cooperate to bear the load of the string tension. As with the device shown in U.S. Pat. No. 5,018,423, however, the grip members and spacer are structural members which will inevitably undergo deformation if made of wood.

Other prior art neck constructions have eliminated the problems of warping and bending associated with wooden necks by replacing the wooden neck with a neck made of a composite material. For example, U.S. Pat. No. 4,846,039 discloses a solid single piece neck construction made of layers of epoxy resin and powdered carbon mixture, with longitudinally laid carbon fibers. A neck made of this material does not bend or warp, and is of sufficient strength to withstand the string tension without deforming, and without the need for additional structural reinforcement.

A significant disadvantage of composite necks, however, is that they have significantly different tonal properties than wooden necks. To many users who prefer the response and tonal coloration associated with traditional wooden necks, composite necks are unacceptable.

One prior art device disclosed in U.S. Pat. No. 4,121,492 has combined a forged aluminum reinforcing member with wooden or plastic inserts with the object of preserving the "desirable feel and appearance of wood or plastic materials". (Col. 1, lines 56–62). This device does not and cannot, however, preserve the response and tonal coloration associated with traditional wooden necks, since the inserts extend only along the length of the neck, and do not extend through the headstock where the strings are attached. Moreover, the reinforcing aluminum member of the '492 patent does not and cannot include appropriate relief adjustment.

It is an object of the invention, therefore, to provide a neck construction for stringed instruments which provides the strength and durability of composite necks, yet which still retains the response and tonal coloration associated with traditional wooden necks.

It is another object of the invention to provide a stringed musical instrument of the above-described type, which comprises a composite central structure made of a composite material of sufficient strength to withstand the entire load imposed on the neck by the tension of the strings, and at least one non-structural, non-load bearing wooden section which extends the length of the neck assembly.

It is yet another object of the invention to provide a stringed musical instrument of the above-described type in which the shape and the type of wood used for the wooden sections can be varied to achieve different tonal properties to suit user preferences.

It is a further object of the invention to provide a stringed musical instrument of the above-described type which includes a truss rod assembly for relief adjustment which is not a necessary structural element of the neck.

SUMMARY OF THE INVENTION

In accordance with these objectives, the present invention is directed to a stringed musical instrument with a neck assembly which provides the strength and durability of composite necks, yet which still retains the response and tonal coloration associated with traditional wooden necks. Preferably, the stringed instrument has a body, a neck assembly with a neck portion and a headstock portion, and strings which are anchored at one end to the body and at the other end under tension to the headstock portion of the neck assembly.

The neck assembly includes a composite central structure which is joined to the body at one end, and which extends away from the body. The composite central structure is made of a composite material which is of sufficient strength so that it can independently bear the entire load imposed on the neck by the tension of the strings. The neck assembly also includes at least one non-structural, non-load bearing wooden insert which is carried by the composite central structure and which extends substantially along the length of the neck assembly. This insert is non-load bearing in that it does not support any of the load imposed on the neck by the tension of the strings, and is non-structural in that its absence will not render the stringed instrument unusable for its normal purposes. The use of the wooden insert or inserts which extend substantially along the length of the neck assembly provides the stringed instrument with the novel feature of having a neck assembly (neck and headstock portions) with the strength and durability of a composite neck, yet having the response and tonal coloration associated with traditional wooden assemblies. The neck assembly further includes a fingerboard which is carried by the composite central structure, and preferably a truss rod assembly for relief adjustment.

In a preferred embodiment of the invention, the composite central structure includes a core, a head plate and a heel plate. The core is attached to the heel plate at one end and to the head plate at the other end. The heel plate is in turn attached to the body. The core is substantially T-shaped in cross-section when viewed along its longitudinal axis. The T-shaped core has a top portion which is substantially parallel to the plane in which the strings lie, and a stem portion which is substantially perpendicular to the top portion. The top portion extends substantially between the body and the headstock portion of the neck assembly, and the stem portion extends substantially along the length of the neck assembly.

Located centrally along the top portion and extending substantially along the length of the top portion is a channel which opens towards the plane of the strings. A truss rod assembly for neck relief adjustment is located in this channel. This truss rod assembly is a non-structural, non-load bearing element capable of a range of adjustment from parallel to the plane of the strings, to overbowed (the fingerboard is closer to the plane of the strings at its center than at either end) or underbowed (the fingerboard is closer to the plane of the strings at its ends than at its center point) to suit individual players' preferences. A fingerboard is affixed to the upper surface of the top portion of the core so as to enclose the truss rod assembly within the channel.

In the preferred embodiment, the top portion of the T-shaped core substantially defines the width of the neck assembly and the stem portion extends substantially to the rear of the neck assembly. Two wooden sections are disposed on opposite sides of the core, and extend substantially along the entire length of the neck assembly. The wood sections have a head portion, a middle portion, and a heel portion. The heel portions are of a shape such that when incorporated into the neck assembly, the neck assembly is substantially rectangular in cross-section. The middle portions are of a shape such that when incorporated into the neck assembly, the neck assembly is substantially semi-circular in cross-section. The head portions are of a shape such that when incorporated with the neck assembly, the core, the head plate, and the head portion together form the shape of the headstock portion.

In another embodiment of the invention, one wooden insert surrounds the stem of the core and extends substantially along the length of the neck assembly. The wooden insert has a head portion, a middle portion and a heel portion. The heel portions is of a shape such that when incorporated into the neck assembly, the neck assembly is substantially rectangular in cross-section. The middle portions is of a shape such that when incorporated into the neck assembly, the neck assembly is substantially semi-circular in cross-section. The head portions is of a shape such that when incorporated with the neck assembly, the core, the head plate, and the head portion together form the shape of the headstock portion.

The core is affixed to the head plate and the heel plate, and the heel plate is affixed to the body by screws or the equivalent, or by an adhesive sufficiently strong to bond the respective elements. Likewise, the fingerboard is affixed to the core, and the at least one wooden insert is affixed to the core by screws of the equivalent, or by an adhesive sufficiently strong to bond the respective elements.

BRIEF DESCRIPTION OF THE DRAWINGS

Further objects, features and advantages of the invention will become apparent from the following detailed description taken in conjunction with the accompanying figures in which.

Figure 1:
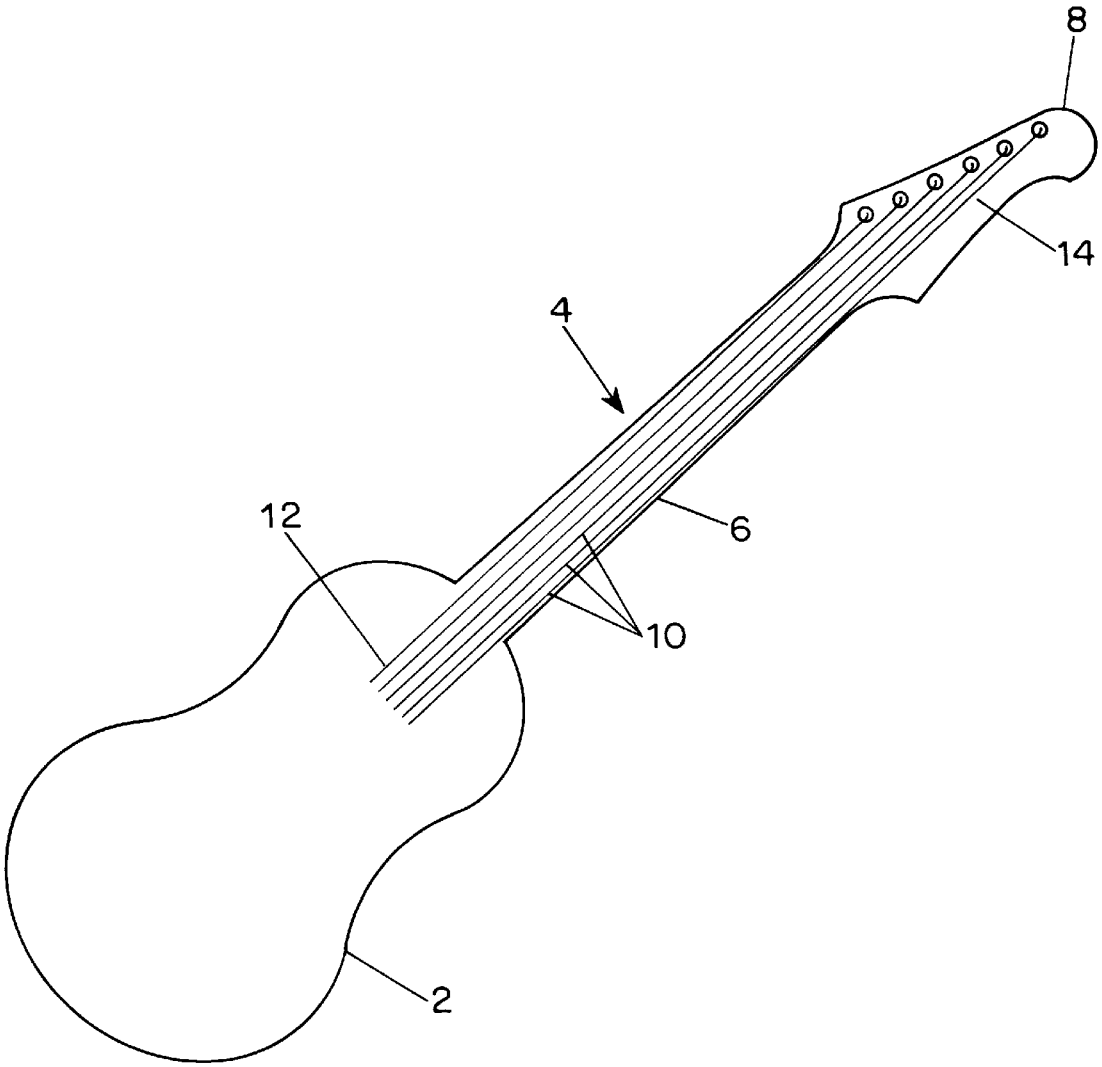
FIG. 1 is a perspective view of a stringed instrument in accordance with the invention.

Throughout the figures, the same reference numerals and characters, unless otherwise stated, are used to denote like features, elements, components or portions of the illustrated embodiment. Moreover, while the subject invention will now be described in detail with reference to the figures, it is done so in connection with preferred embodiments. It is intended that changes and modifications can be made to the described embodiments without departing from the true scope and spirit of the subject invention as defined by the appended claims.

DETAILED DESCRIPTION

Figure 2:
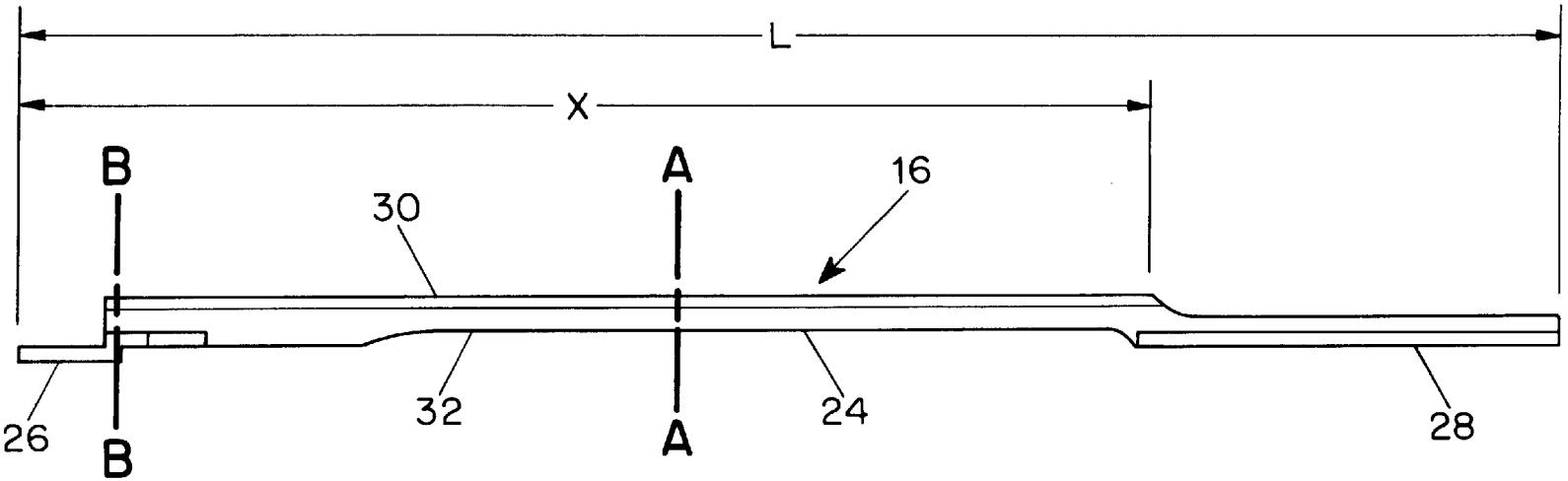
FIG. 2 is a side view of the composite central structure of the neck assembly in accordance with the invention.
Figure 3:
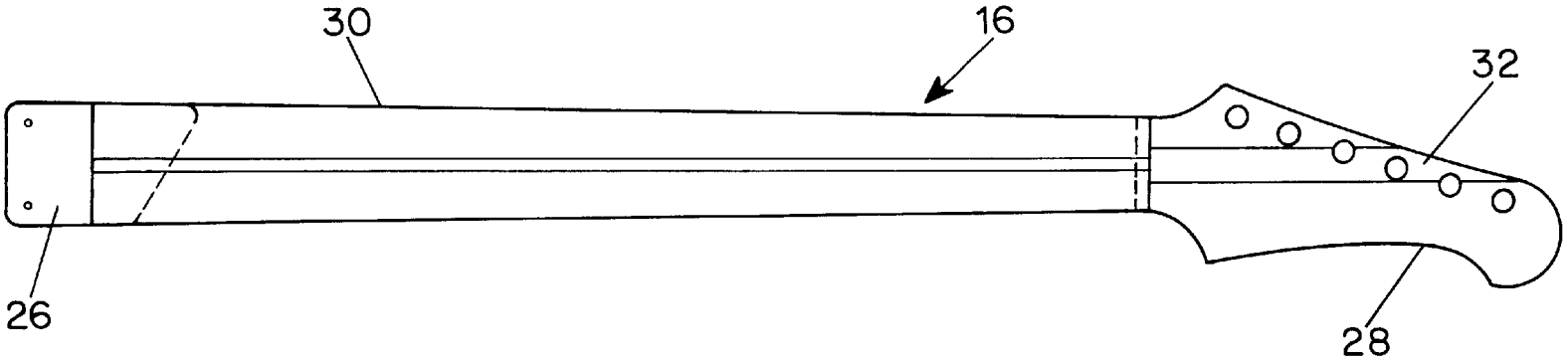
FIG. 3 is a top view of the composite central structure of the neck assembly in accordance with the invention.

FIG. 1 illustrates a stringed instrument with a body 2, a neck assembly 4 having a neck portion 6 and a headstock portion 8, and strings 10 which are anchored at a first end 12 to the body 2 and which are anchored under tension at a second end 14 to the headstock portion 8. The neck assembly 4 of the present invention comprises a composite central structure 16 (shown alone in FIGS. 2–3) which preferably is joined to and extends away from the body. The composite central structure 16 is made of a composite material, the word "composite" meaning a compound of graphite fibers impregnated with epoxy resins. While preferably made of graphite reinforced with plastic, any sufficiently rigid composite material can be used. The composite central structure 16 is of sufficient strength to bear the entire load imposed on the neck by the tension of the strings. In other words, it is sufficiently rigid to resist the tension of the strings without deformation, and without the need for additional reinforcement.

Figure 4:
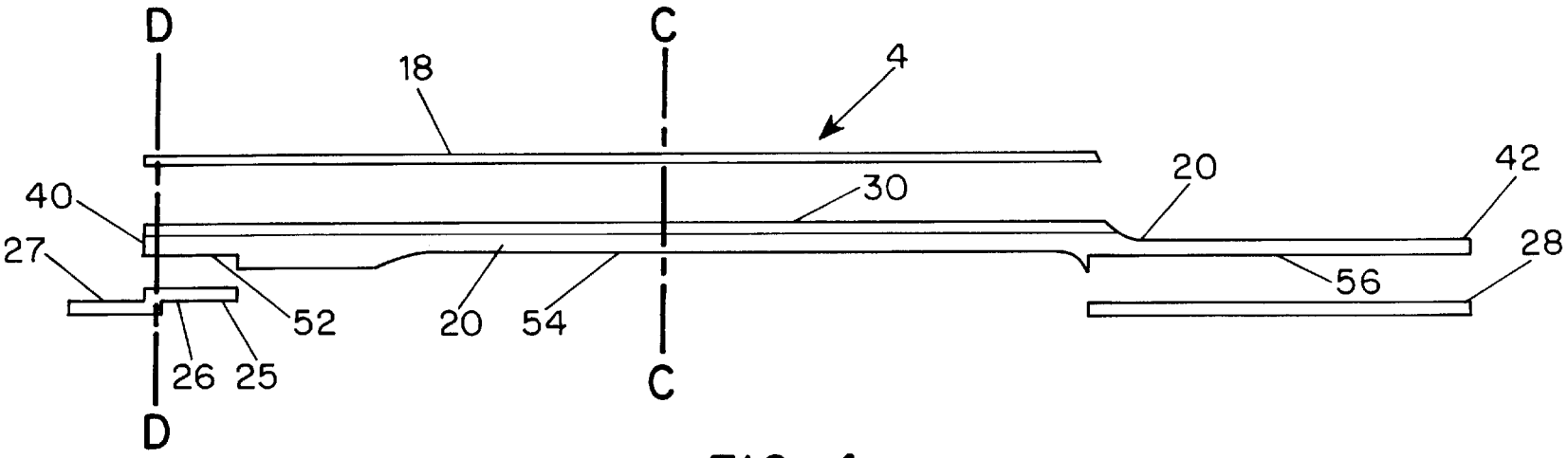
FIG. 4 is a side view of the neck assembly in accordance with the invention.
Figure 5:
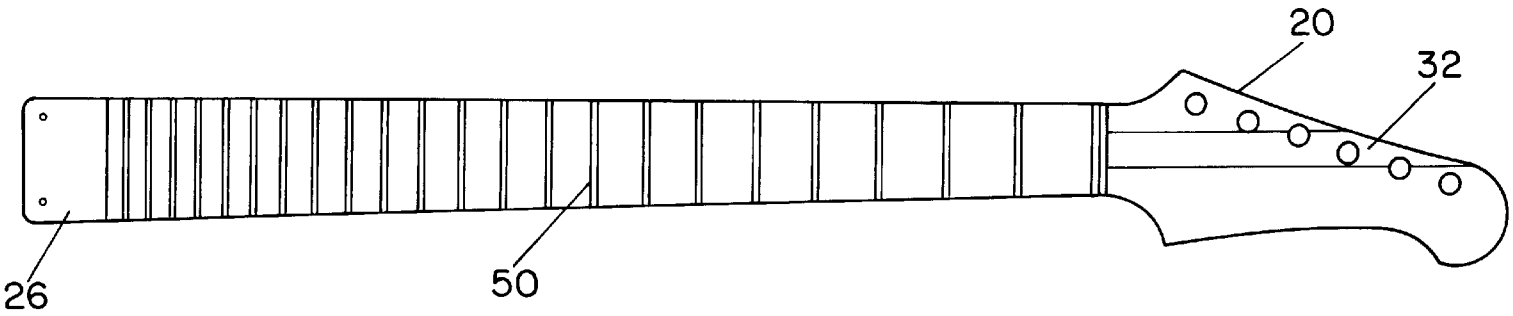
FIG. 5 is a top view of the neck assembly in accordance with the invention.

The composite central structure can be described with reference to FIGS. 2–7, bearing in mind that unlike FIGS. 2–3 and 6–7 which only show the composite central structure, FIGS. 4–5 show the entire neck assembly. In a preferred embodiment of this invention, the complete neck assembly includes a composite central structure 16 comprising a core 24, a heel plate 26 and a head plate 28. The core 24 preferably extends from the body through the headstock portion 8 of the neck assembly over a length L.

Figure 6:
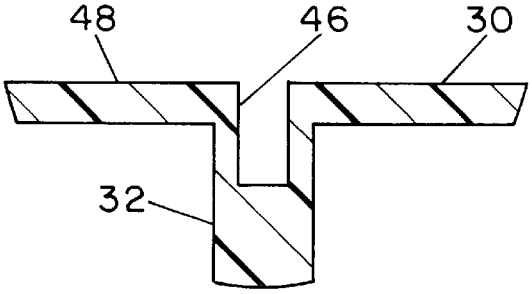
FIG. 6 is a cross-sectional view of the composite central structure of the neck assembly taken along line A—A of FIG. 2.
Figure 7:
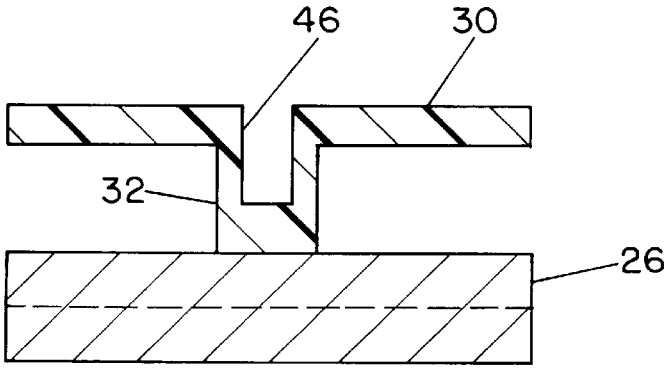
FIG. 7 is a cross-sectional view of the composite central structure of the neck assembly taken along line B—B of FIG. 2.
Figure 8:
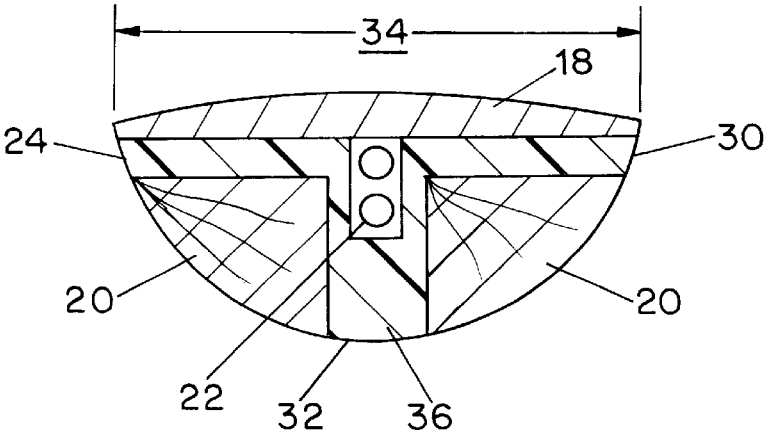
FIG. 8 is a cross-sectional view of the neck assembly taken along line C—C of FIG. 4.

As seen in FIGS. 6 and 7, the core 24 is of substantially T-shaped cross-section when viewed along its longitudinal axis, with a top portion 30 which forms the top of the T-shape, and a stem portion 32 which forms the stem of the T-shape. The top portion 30 extends substantially along the neck portion, and the stem portion 32 extends substantially over length L. As seen in FIG. 8, the top portion 30 substantially defines the width 34 of the neck assembly and the stem portion 32 extends substantially to the rear side 36 of the neck. The top portion 30 of the core 24 lies in a plane substantially parallel to the plane defined by the strings 10, and the stem portion 32 of the core 24 is substantially perpendicular to the top portion 30.

Screws or an equivalent means attach the near end 40 of the core 24 to a first portion 25 of the heel plate 26, and a distal end 42 of the core to the head plate 28. Screws or an equivalent means also attach the second portion 27 of the heel plate 26 to the body 2 of the stringed instrument, thereby connecting the neck assembly 4 with the body 2.

Located substantially centrally along the top portion 30 of the core 24, lies a channel 46 (FIGS. 6–7). The channel extends substantially along the length X of the top portion 30 of the core 24, and opens in the direction of the plane of the strings 10.

FIGS. 4–5 and 8–9 illustrate additional elements which are carried by the composite central structure in the preferred embodiment. A fingerboard 18 is affixed by screws or an equivalent means, or by a suitable adhesive to the upper surface 48 (FIG. 6) of the top portion 30 of the core 24. The fingerboard encloses a truss rod assembly 22, described below, which preferably lies within the channel 46. Frets 50 are affixed to the fingerboard 18 in a standard manner.

The truss rod assembly 22 (shown in FIGS. 8 and 9) are a type known in the art, for adjusting the measurement of the curve along the top surface of the neck assembly relative to the constant plane of the tensioned strings 10 above it; this is otherwise known as relief adjustment. This truss rod assembly is a non-structural, non-load bearing element capable of a range of adjustment from parallel to the plane of the strings, to overbowed (the fingerboard is closer to the plane of the strings at its center than at either end) or underbowed (the fingerboard is closer to the plane of the strings at its ends than at its center point) to suit individual players' preferences. It is a non-structural element in the sense that its removal would not render the stringed instrument unusable for its normal purposes. It is also non-load bearing in the sense that it does not bear any of the load imposed on the neck assembly by the tension of the strings. This is because the composite central structure is capable of bearing the entire load. Thus, the assembly 22 can more effectively make fine adjustments to suit user preferences.

Figure 9:
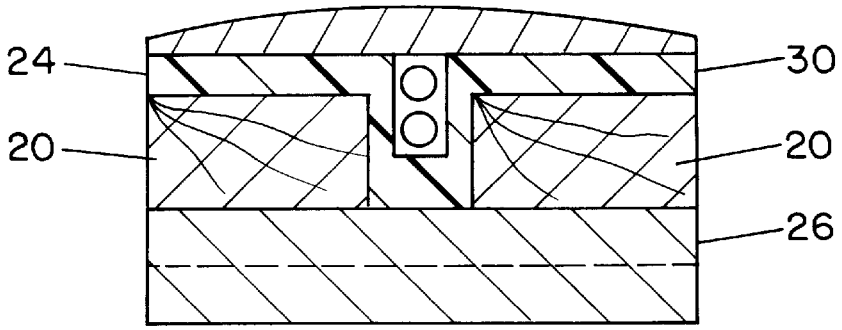
FIG. 9 is a cross-sectional view of the neck assembly taken along line D—D of FIG. 4.

Also affixed to the composite central structure 16 by screws or the equivalent or by a suitable adhesive are (as shown in FIGS. 4–5 and 8–9) two non-structural, non-load bearing wooden inserts 20, which are disposed on opposite sides of the core 24. These wood inserts 20 extend substantially along the length of the neck assembly 4. The wooden inserts are non-structural in the sense that their absence would not render the stringed instrument unusable for its normal purpose. They are non-load bearing in the sense that they do not support any of the load imposed on the neck by the tension of the strings. The wood inserts have a heel portion 52, a middle portion 54, and a head portion 56. The shape of the wooden inserts at the heel portion are such that when incorporated into the neck assembly, the neck assembly is substantially rectangular in cross-section, as shown in FIG. 9. The shape of the wooden inserts at the middle portion are such that when incorporated into the neck assembly, the neck assembly is substantially semi-circular in cross-section as shown in FIG. 8. The shape of the wooden inserts at the head portions are such that when incorporated into the neck assembly, the core, head plate, and the wooden inserts together define the shape of the headstock portion.

Figure 10:
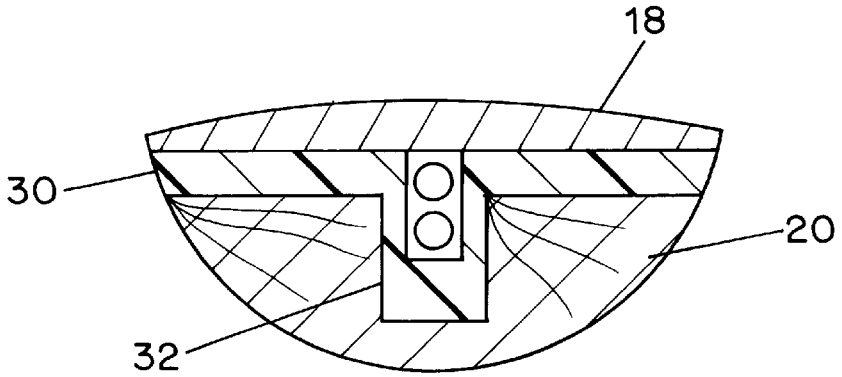
FIG. 10 is a cross-sectional view of an alternate embodiment of the neck assembly taken along line C—C of FIG. 4.
Figure 11:
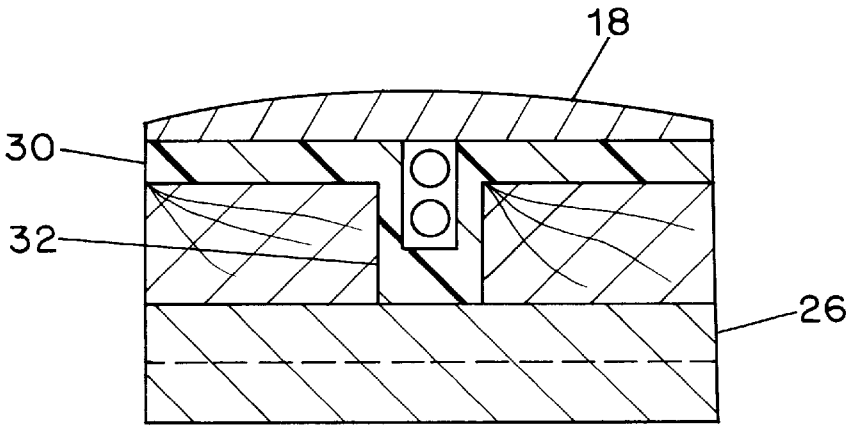
FIG. 11 is a cross-sectional view of an alternate embodiment of the neck assembly taken along line D—D of FIG. 4.

In another embodiment of the invention shown in FIGS. 10 and 11, a single non-structural, non-load bearing wooden insert 20 is affixed to the composite central structure by screws or the equivalent, or by a suitable adhesive. This one wooden insert 20 surrounds the stem portion 32 of the core 24 of the central composite neck structure, and extends substantially along the length of the neck assembly. This one wooden insert also has a heel portion 52, a middle portion 54, and a head portion 56. The shape of the wooden insert at the heel portion is such that when incorporated into the neck assembly, the neck assembly is substantially rectangular in cross-section, as shown in FIG. 11. The shape of the wooden insert at the middle portion is such that when incorporated into the neck assembly, the neck assembly is substantially semi-circular in cross-section, as shown in FIG. 10. The shape of the wooden insert at the head portions is such that when incorporated into the neck assembly, the core, head plate, and the wooden inserts together define the shape of the headstock portion.

The above disclosure results in a stringed musical instrument which is not susceptible to the problems of warping and bending associated with instruments with traditional wooden assemblies, which is able to control resonance and retain the tonal qualities associated with traditional wooden neck assemblies, and which includes a means for relief adjustment which is a non-structural, nonload bearing element, thus enabling more precise adjustments.

Other modifications of the invention will be obvious to those skilled in the art, and it is intended that the scope of the invention be limited only as set forth in the appended claims.

I claim:

1. A stringed musical instrument comprising a body and a neck assembly of a certain length, said neck assembly having a headstock portion and a neck portion connection said headstock portion to said body, said neck assembly comprising:

a composite central structure extending substantially along the length of the neck assembly into the headstock portion, said composite central structure being of sufficient strength to independently bear the load imposed on the neck assembly by the strings and said composite central structure comprising:

a core having a length extending substtially along the length of the neck assembly into the headstock portion, the core having a near end and a distal end;

a head plate;

a heel plate having a first end and a second end;

first means for attaching the head plate to the distal end of the core;

second means for attaching the first end of the heel plate to the near end of the core; and third means fo attaching said second end of the heel plate to the body, wherein the core is substantially T-shaped in cross-section when viewed along a longitudinal axis, the core having a top portion and a stem portion, the top portion being located in plane substantially parallel to a plane defined by the strings and extending substantially along a length from the body to the headstock portion of the neck assembly, the top portion substantially defining a width of the neck assembly, and said stem portion being substantially perpendicular to the top portion and extending substantially along the length of the neck assembly into the head-stock portion, the stem portion substantially extending to a rear side of the neck assembly; and the neck assembly further comprising:

at least one non-structural, non-load bearing wooden insert carried by the composite central structure and substantially extending along the length of the neck assembly into the headstock portion for imparting tonal qualities associated with traditional wooden neck assemblies, the at least one wooden insert comprising two wooden inserts disposed on opposite sides of the core, each of said wooden inserts having a head portion, a middle portion, and a heel portion, the heel portions having a shape such that when incorporated into the neck assembly the neck assembly is substantially rectangular in cross-section, the middle portions having a shape such that when incorporated into the neck assembly the neck assembly is substantially semi-circular in cross-section, and the head portions having a shape such that when incorporated into the neck assembly, the core, the head plate, and the head portion together define the shape of the headstock portion of the neck assembly.

2. A neck assembly of a certain length for attachment to the body of a stringed musical instrument, said neck assembly comprising a headstock portion and a neck portion, and further comprising:

a composite central structure extending substantially along the length of the neck assembly into the headstock portion, said composite central structure being of sufficient strength to independently bear the load imposed on the neck assembly by the strings and said composite central structure comprising:

a core having a length extending substantially along the length of the neck assembly into the headstock portion, the core having a near end and a distal end;

a head plate;

a heel plate having a first end and a second end;

first means for attaching the head plate to the distal end of the core;

second means for attaching the first end of the heel plate to the near end of the core; and third means for attaching said second end of the heel plate to the body, wherein the core is substantially T-shaped in cross-section when viewed along a longitudinal axis, the core having a top portion and a stem portion, the top portion being located in plane substantially parallel to a plane defined by the strings and extending substantially along a length from the body to the headstock portion of the neck assembly, the top portion substantially defining a width of the neck assembly, and said stem portion being substantially perpendicular to the top portion and extending substantially along the length of the neck assembly into the head-stock portion, the stem portion substantially extending to a rear side of the neck assembly; and the neck assembly further comprising:

at least one non-structural, non-load bearing wooden insert carried by the composite central structure and substantially extending along the length of the neck assembly into the headstock portion for imparting tonal qualities associated with traditional wooden neck assemblies, the at least one wooden insert comprising two wooden inserts disposed on opposite sides of the core, each of said wooden inserts having a head portion, a middle portion, and a heel portion, the heel portions having a shape such that when incorporated into the neck assembly the neck assembly is substantially rectangular in cross-section, the middle portions having a shape such that when incorporated into the neck assembly the neck assembly is substantially semi-circular in cross-section, and the head portions having a shape such that when incorporated into the neck assembly, the core, the head plate, and the head portion together define the shape of the headstock portion of the neck assembly.

* * * * *